US007124546B2

(12) United States Patent
Scharff et al.

(10) Patent No.: US 7,124,546 B2
(45) Date of Patent: Oct. 24, 2006

(54) MUNTIN BAR CONNECTOR WITH POSITIONING TABS

(75) Inventors: John Wayne Scharff, Pella, IA (US); Lawrence A. Schneider, Pella, IA (US)

(73) Assignee: Pella Corporation, Pella, IA (US)

( * ) Notice: Subject to any disclaimer, the term of this patent is extended or adjusted under 35 U.S.C. 154(b) by 241 days.

(21) Appl. No.: 10/715,634

(22) Filed: Nov. 18, 2003

(65) Prior Publication Data

US 2005/0102957 A1 May 19, 2005

(51) Int. Cl.
*B44F 7/00* (2006.01)

(52) U.S. Cl. ..... 52/314; 52/656.6; 52/656.8; 52/656.9; 52/713; 52/456; 52/702; 52/712; 52/665; 52/204.61; 52/98; 52/108

(58) Field of Classification Search ..... 52/314, 52/311.3, 204.61, 704, 712, 656.9, 656.8, 52/665; 403/255, 254, 187, 298, 247, 252, 403/460

See application file for complete search history.

(56) References Cited

U.S. PATENT DOCUMENTS

| | | | | |
|---|---|---|---|---|
| 1,410,514 | A | | 3/1922 | Ryan |
| 3,411,258 | A | | 11/1968 | Kessler |
| 3,686,814 | A | | 8/1972 | Anderson |
| 3,785,110 | A | | 1/1974 | Galloway et al. |
| 3,946,531 | A | | 3/1976 | Armstrong |
| 4,019,300 | A | | 4/1977 | Sauer et al. |
| 4,683,634 | A | | 8/1987 | Cole |
| 4,707,963 | A | | 11/1987 | Governale |
| 4,783,938 | A | | 11/1988 | Palmer |
| 4,845,911 | A | | 7/1989 | Winston et al. |
| 4,949,521 | A | | 8/1990 | Riegelman et al. |
| 4,970,840 | A | | 11/1990 | Ouellette et al. |
| 4,989,384 | A | | 2/1991 | Kinghorn et al. |
| 5,048,997 | A | | 9/1991 | Peterson |
| 5,099,626 | A | * | 3/1992 | Seeger ..... 52/314 |
| 5,177,920 | A | | 1/1993 | Rafeld |
| 5,657,590 | A | * | 8/1997 | Digman et al. ..... 52/204.61 |
| 5,678,376 | A | * | 10/1997 | Poma ..... 52/656.8 |
| 5,678,377 | A | * | 10/1997 | Leopold ..... 52/656.9 |
| 5,791,102 | A | | 8/1998 | Sheath et al. |
| 5,899,033 | A | | 5/1999 | Merchlewitz |
| 6,026,621 | A | | 2/2000 | Fisher |
| 6,244,012 | B1 | * | 6/2001 | McGlinchy et al. ..... 52/665 |
| 6,301,843 | B1 | * | 10/2001 | Silverman ..... 52/204.5 |
| 6,425,221 | B1 | | 7/2002 | Reichert |

FOREIGN PATENT DOCUMENTS

| | | |
|---|---|---|
| DE | 3225651 | 1/1984 |
| JP | 5179754 | 7/1993 |

* cited by examiner

*Primary Examiner*—Naoko Slack
*Assistant Examiner*—Yvonne M. Horton
(74) *Attorney, Agent, or Firm*—Faegre & Benson LLP

(57) ABSTRACT

A connector for holding an internal muntin assembly away from a perimeter spacer of an insulating glass assembly until the assembler is ready to affix the muntin bar to the perimeter bar using an attachment device. The connector includes a positioning tab for holding the muntin bar away from the perimeter spacer to allow positioning of the muntin bar assembly until the positioning tab is moved relative to a baseplate so that the attachment device, such as thick double stick tape, is pressed to the perimeter spacer.

25 Claims, 11 Drawing Sheets

MUNTIN BAR CONNECTOR WITH POSITIONING TABS

TECHNICAL FIELD

The present invention relates to the field of windows and more specifically to the field of grills for windows.

BACKGROUND OF THE INVENTION

It has become a design trend for windows to include a grill to enhance the aesthetic look of the window. For example, U.S. Pat. No. 3,686,814 (Anderson) shows false muntin bars 20 and 22 positioned on a window.

Many different methods of attaching the grills to the window frame were developed. In U.S. Pat. No. 5,657,590 (Digman et al.), an end connector was shown (see FIGS. 3 and 4) for connecting a muntin bar to a window frame (see FIG. 1). The end connector included a spine, a stabilizing end, fins, a platform 38 and pins. The stabilizing end was inserted into open ends of the muntin bar and engaged with the holes to hold the bar in place. End connectors in U.S. Pat. No. 5,678,376 (Poma) and U.S. Pat. No. 6,425,221 (Reichert) operated in a similar manner.

A problem with the prior art approach was that it required the drilling of many holes in the window frame or glass frame. This involved much labor and could lead to broken seals in insulated glass packs.

SUMMARY OF THE INVENTION

The present invention is a new muntin bar connector with a positioning device and an adhesive. In one embodiment, the connector includes a baseplate, a muntin bar tab, an adhesive on the baseplate and a positioning tab connected to the baseplate. The muntin bar tab is connected to a muntin bar to be positioned relative to a window. The positioning tab is positioned such that the adhesive is held away from a frame of the window until the spring tab is depressed. The positioning tab may be formed as an extension to the baseplate, or through formation or fixation of a resilient structure to a bottom side of the baseplate.

In another embodiment, the connector includes a baseplate, a muntin bar tab, an adhesive on the baseplate and first and second positioning tabs connected to the baseplate. Resilient fingers are positioned along the muntin bar tab to further engage the muntin bar As a further enhancement to this embodiment, lock tabs that engage with tabs on the resilient fingers, may be included on the positioning tabs to hold the positioning tabs in a particular position after the muntin bar assembly is installed in a window. As a further enhancement, tabs may be placed on the bottom surface of the baseplate to hold the adhesive in position during positioning of the muntin bar and connector adjacent to the frame.

In yet another embodiment, a connector includes a baseplate, a muntin bar tab, an adhesive and posts extending from or through the baseplate. The adhesive can be placed between the posts. The posts may include braces to connect the posts to the baseplate and to provide a hinge point for the posts.

In still another embodiment, a connector includes a baseplate, a muntin bar tab formed on the baseplate as a collar for holding the muntin bar therein and an adhesive. The connector may include one or more positioning tabs.

In operation, the connector may be associated with a muntin bar and then positioned adjacent to a frame used to separate panes of glass in a multiple glazing glass unit. The positioning tabs serve to prevent the adhesive from adhering to the frame until the installer is ready to finally position the muntin bar. By causing relative movement between the baseplate and the positioning tabs, through as an example pressure on the muntin bar toward the frame, the adhesive is placed in contact with the frame and the muntin bar connector becomes affixed to the frame.

DETAILED DESCRIPTION OF THE INVENTION

Figure 1:
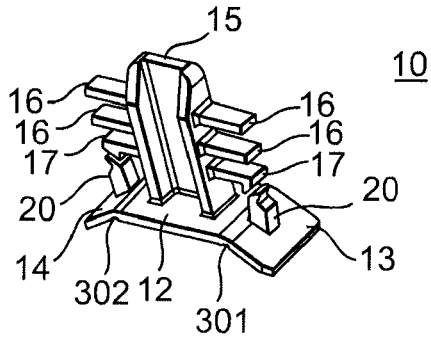
FIG. 1 is a right front perspective view of a first connector of the present invention.
Figure 2:
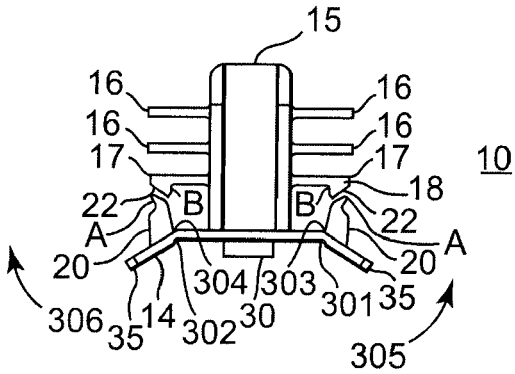
FIG. 2 is a front plan view of the connector of FIG. 1.
Figure 7A:
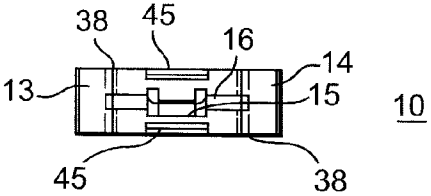
FIG. 7A is a top view of the connector of FIG. 7.
Figure 7:
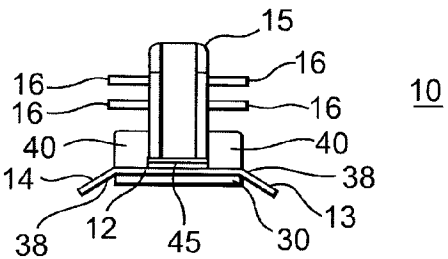
FIG. 7 is a front elevation view of another embodiment of the connector.
Figure 7B:
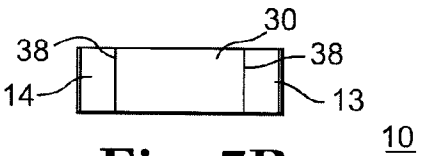
FIG. 7B is a bottom view of the connector of FIG. 7.
Figure 7C:
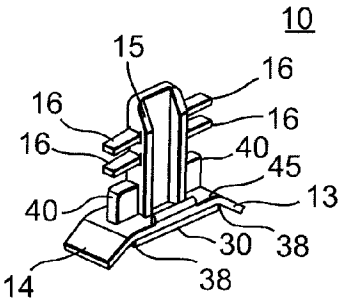
FIG. 7C is a left front perspective view of the connector of FIG. 7.
Figure 7D:
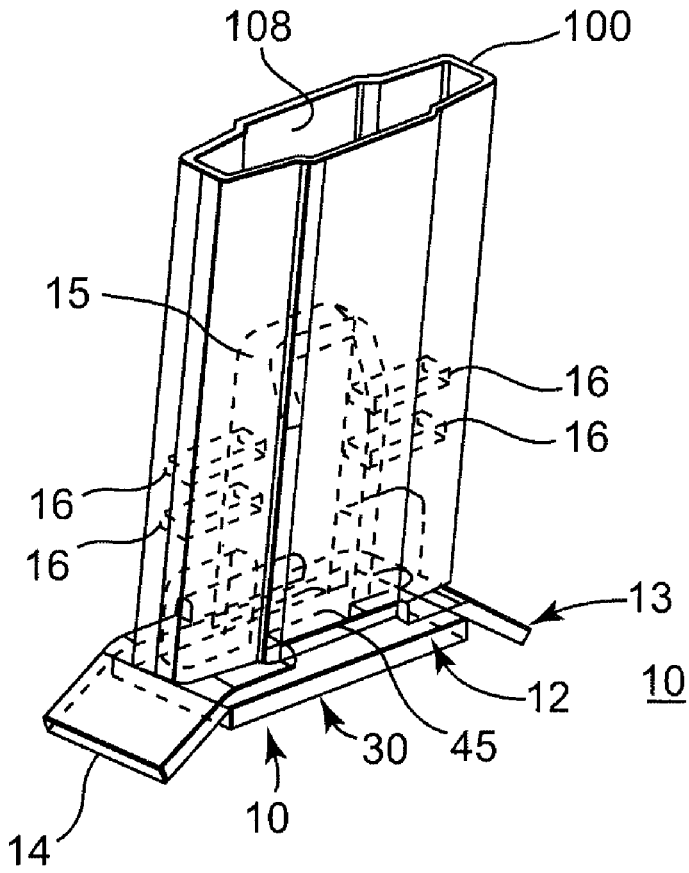
FIG. 7D is a left front perspective view of the connector of FIG. 7, installed in a muntin bar.

Referring now to FIGS. 1 and 2, thereshown is a connector 10 of the present invention. Connector 10 includes baseplate 12 and muntin bar tab 15. In use, the muntin bar tab is connected to a muntin bar (see FIG. 7D for an example) and the baseplate is mounted on a window frame.

The muntin bar tab in this embodiment is generally a rectangular prism extending from the baseplate. It is advisable to make the size and shape of the baseplate at least generally match the shape of the cavity into which it will be inserted and preferably make the surface area large enough to cover the entire opening. The baseplate includes first and second positioning tabs 13 and 14. The positioning tabs can be formed by forming narrowed regions 301 and 302, of the baseplate. A resilient effect is generated when positioning tab 13 is moved in the direction of arrow 305. Region 303 is compressed in such a movement and provides the spring force to return the tab to a downward orientation. Region 304 works in a similar way when positioning tab 14 is moved in the direction of arrow 306.

Resilient fingers 16 are formed on muntin bar tab 15 to ensure proper placement of the tab within the muntin bar. The tips of the resilient finger can engage with the internal surface of the muntin bar to provide a holding force to keep the connector in place within the muntin bar.

An additional resilient finger 17 can be provided on each side, just above the positioning tabs. The positioning tabs may include locking tabs 20 while the resilient fingers 17 can include lock 18. Locks 18 extend toward locking tabs 20, and include a sloped portion along which projection 21 of locking tab 20 may ride when the locking tabs are moved in the directions indicated by arrows 305 and 306, until surface A of the locking tabs are resting on surface B of the locks. At this point, the positioning tabs are restrained and the baseplate and the first and second positioning tabs form a substantially planar surface.

Figure 1A:
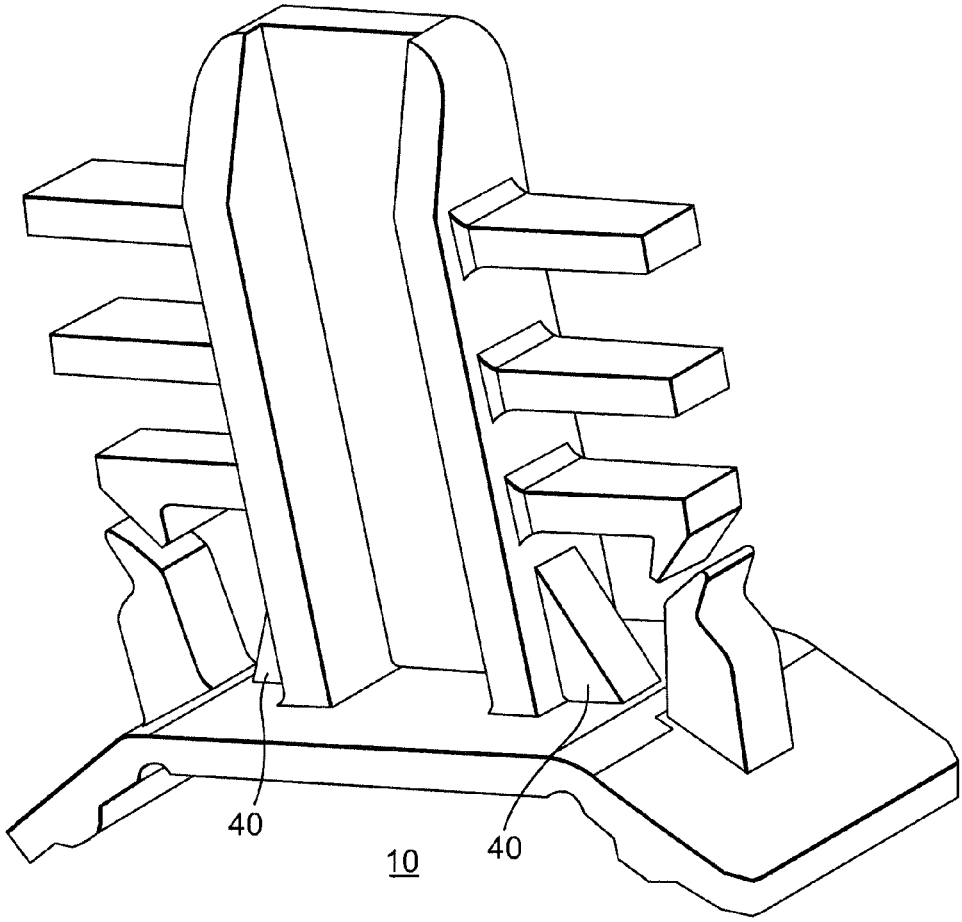
FIG. 1A is a perspective view of the connector of FIG. 1 with a reinforcing rib.

In FIG. 1A, an alternate embodiment of the connector is shown that includes reinforcing ribs 40 at the base of the muntin bar tab. The reinforcing ribs limit the amount of relative motion that can occur between the baseplate and the tab.

In FIG. 2, an adhesive 30 is shown. Before the positioning tabs are locked in place, the adhesive is shielded from a surface to which it will be attached by ends 35 of the positioning tabs making contact with the attachment surface. As described above, the positioning tabs, when moved in the direction of arrows 305 and 306 will lock in place and form a generally planar surface on the bottom side of the baseplate and the adhesive can then contact the attachment surface. The adhesive used is a matter of design choice subject to design constraints of, for example, the materials used in forming the connector and the attachment surface, temperature range and humidity. One adhesive that is particularly useful is double stick foam tape available from 3M Company.

Figure 3:
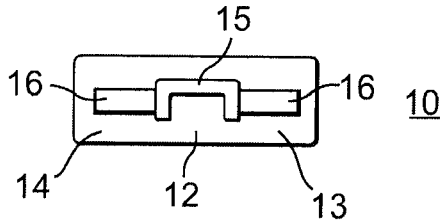
FIG. 3 is a top view of the connector of FIG. 1.

In FIG. 3, a top view of the connector of FIG. 1 is shown.

Figure 4:
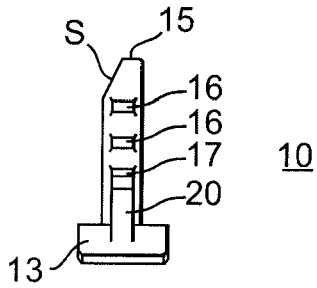
FIG. 4 is a right side plan view of the connector of FIG. 1.

FIG. 4 is a right side plan view of the connector of FIG. 1. Note that the left side view would be substantial the same except that slope S would be located on the right side of the Figure instead of the left.

The connector may be formed by injection molding using, for example, a material such as NORYL™ thermoplastic resin from General Electric. Preferred materials for forming the connector have a high modulus of elasticity (good spring rate), non-absorbency, does not out gas or get brittle in a hot dry environment such as is found inside of insulating glass units.

Figure 4A:
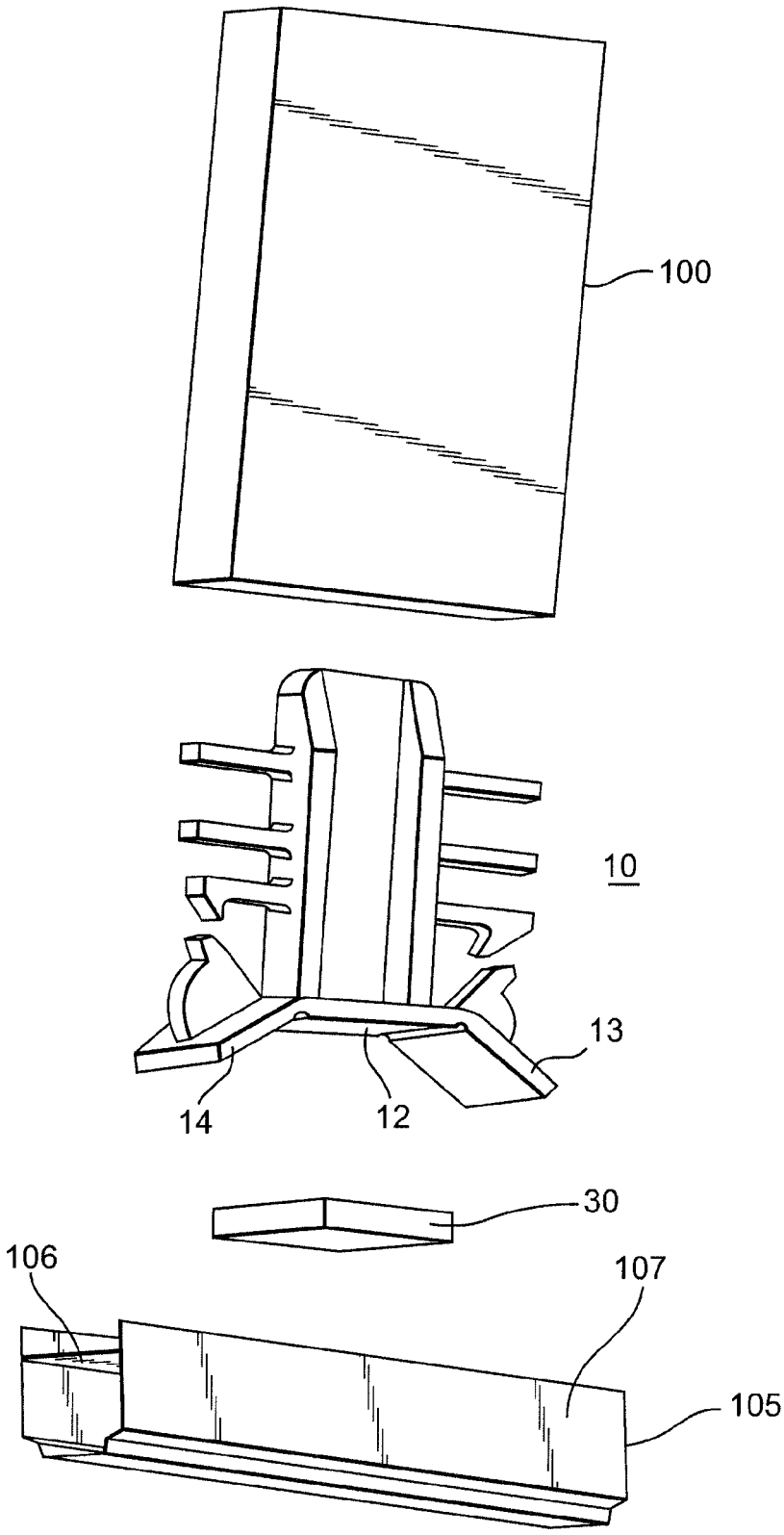
FIG. 4A is an exploded view of a connector for insertion into a muntin bar and a window channel into which the connector is installed.

Referring now to FIG. 4A, thereshown is a connector 10 in relationship with a muntin bar 100 and a window channel 105. Window channel 105 may be generally a u-shaped channel (although virtually any shape may be used such as a combination of the shapes shown in FIG. 4A or a box shape) to be positioned between two panes of glass (not shown). One pane of glass would be positioned adjacent to side 107 and held in place by an adhesive/sealant such as polyisobutyral. The muntin bar grid is then put into position. Positioning tabs 13 and 14 hold the bottom of baseplate 12 away from the inside base surface 106 of the window channel 105 until an installer is ready to position the muntin bar. Adhesive 30, which is normally carried on the bottom of the baseplate, is consequently held away from the inside base surface 106 and attachment therefore does not occur until the positioning tabs 13 and 14 are depressed by the installer. In operation, the connector may be associated with a muntin bar and then positioned adjacent to a frame used to separate panes of glass in a multiple glazing glass unit. The positioning tabs serve to prevent the adhesive from adhering to the frame until the installer is ready to finally position the muntin bar. By causing relative movement between the baseplate and the positioning tabs, through as an example pressure on the muntin bar toward the frame, the adhesive is placed in contact with the frame and the muntin bar connector becomes affixed to the frame. Another pane of glass is then positioned on the other outside surface of the channel (not shown).

Figure 5:
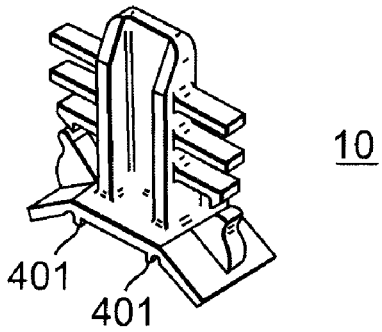
FIG. 5 is a left front perspective view of a second connector of the present invention.
Figure 6:
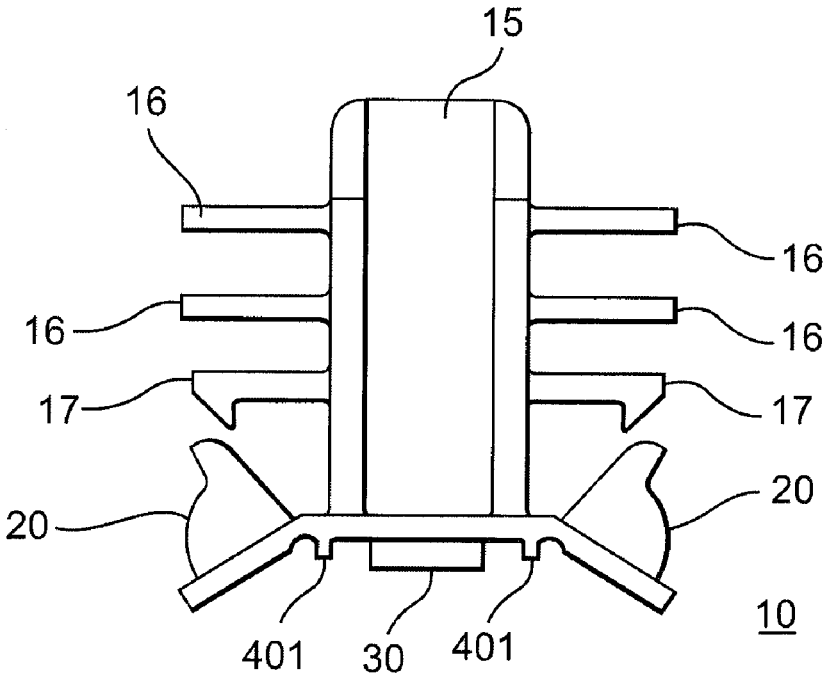
FIG. 6 is a front plan view of the connector of FIG. 5.

Referring now to FIG. 5, thereshown is another embodiment of the present invention. While this embodiment is substantially similar to the embodiment of FIG. 1, tabs 401 have been added. The tabs 401 help position the double stick tape or adhesive material at the attachment site. FIG. 6 shows a front plan view of the connector of FIG. 5. As can be seen, the thickness of adhesive 30 is preferably greater than the extent of downward projection of the tabs 401.

Referring now to FIGS. 7 and 7A–C, thereshown are a front elevation view, a top view, a bottom view and a left front perspective view of another embodiment of a connector. This connector includes a baseplate 12, positioning tabs 13 and 14, tab 15 and resilient fingers. This embodiment differs from the earlier embodiments in that it includes base tabs 45 to compress the muntin bar when installed. The base tabs are positioned so that the muntin bar is positioned between the tab 15 and the base tabs 45. This can be seen in FIG. 7D. Muntin bar 100 maybe made, for example, from rolled aluminum and is formed so as to fit between sheets of glass. The resilient fingers 16 make contact with the interior side walls 108 of the muntin bar 100 to hold the connector in place.

Figure 8:
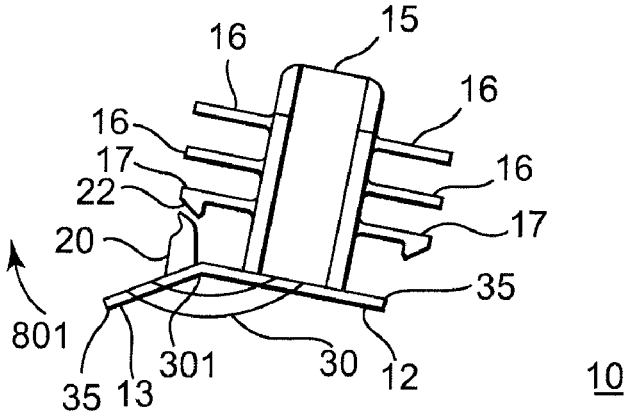
FIG. 8 is a front plan view of another embodiment of the connector.

Referring now to FIG. 8, another embodiment of the inventive connector is shown. Here, only one spring tab 13 is used and only one region 301 is formed. The adhesive 30 extends between the spring portion 13 and the baseplate 12. Only one resilient finger with a lock 17 is used to engage locking tab 20. Resilient fingers 16 may be used to provide a more secure positioning of the connector within the muntin bar. Again, movement of the positioning tab in the direction of arrow 801 causes the adhesive to become unshielded by contact points 35 and to make contact with a window frame (not shown).

Figure 9:
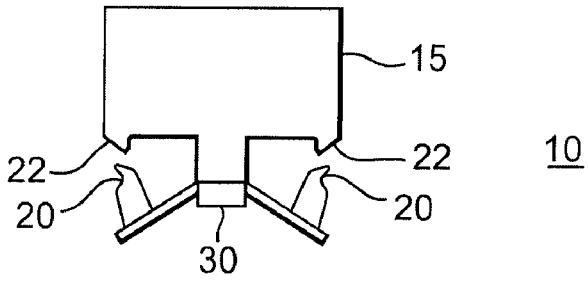
FIG. 9 is a front plan view of yet another embodiment of the connector.

Referring now to FIG. 9, thereshown is yet another embodiment of a connector 10. Here, the muntin bar tab 15 has been extended to the full width of the muntin bar into which it will be inserted. In other respects is may be the same as the connector of FIG. 1, or incorporate the single positioning tab feature of the connector of FIG. 8.

Figure 10:
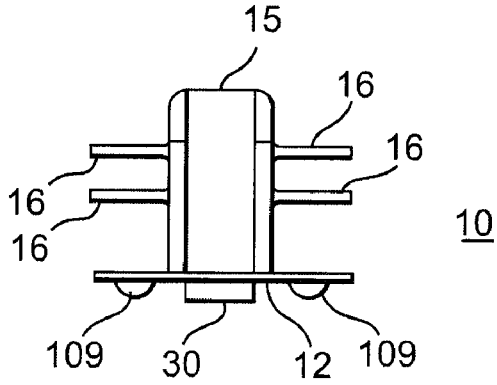
FIG. 10 is a front plan view of still another embodiment of the connector.

Referring now to FIG. 10, thereshown is still another embodiment of the presently inventive connector. Here, positioning tabs 109 may be formed out of baseplate 10 by, for example, cutting and stretching a portion of the baseplate to form leaf springs.

Figure 11:
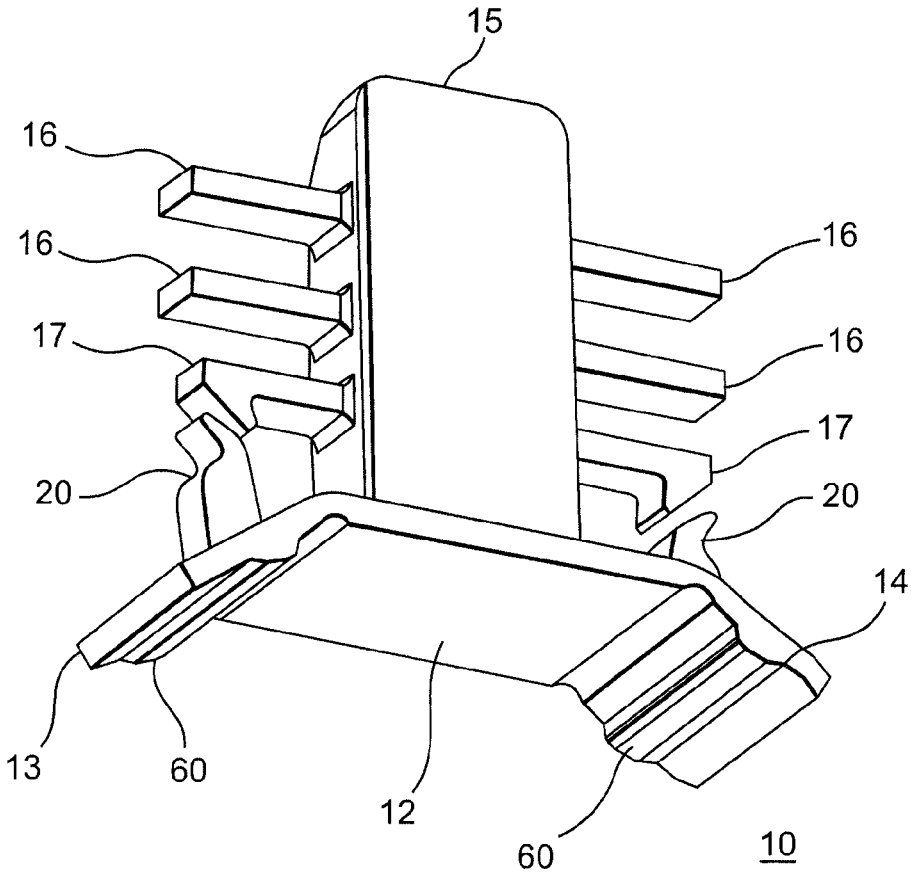
FIG. 11 is a rear perspective view of another embodiment of the connector.
Figure 11A:
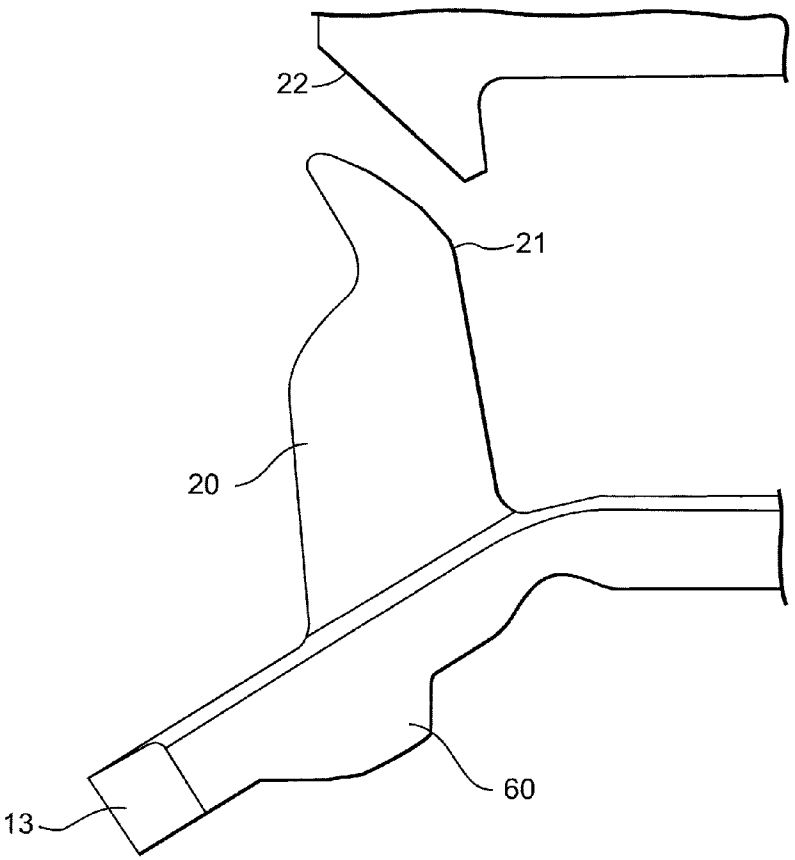
FIG. 11A is a plan view of a locking tab and bump of the connector of FIG. 11.

Referring now to FIG. 11, thereshown is a rear perspective view of yet another embodiment of the connector 10. In this embodiment, bumps 60 have been added to the bottom side of the positioning tabs 13 and 14. The bumps provide the benefit of assisting in positioning of the adhesive and to assist in the locking of the locking tabs. In FIG. 11A, an expanded view of a bump 60 is shown. While no particular shape is required, it in one embodiment, the bump extends from the bottom side of the positioning tab 13 by approximately 50 percent of the width of the positioning tab itself.

Figure 12A:
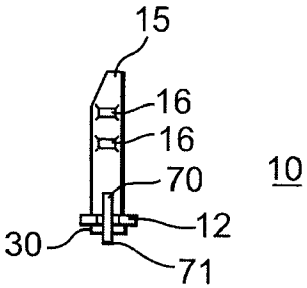
FIG. 12A is a right elevation view of the connector of FIG. 12.
Figure 12B:
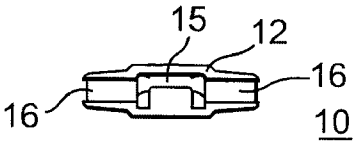
FIG. 12B is a top view of the connector of FIG. 12.
Figure 12:
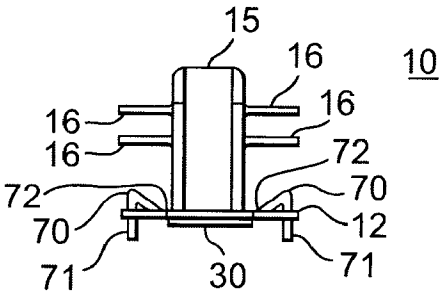
FIG. 12 front elevation view of yet another embodiment of the connector.
Figure 13:
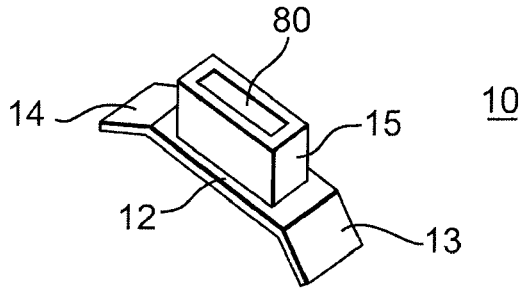
FIG. 13 is a front perspective view of still another embodiment of the connector of the present invention.
Figure 13A:
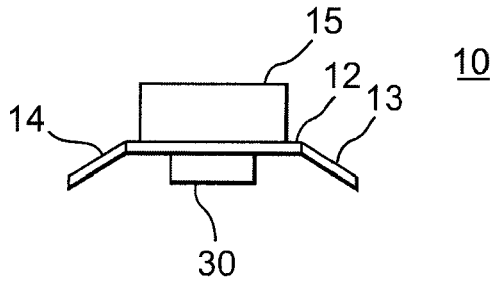
FIG. 13A is a front elevation view of the connector of FIG. 13.
Figure 13B:
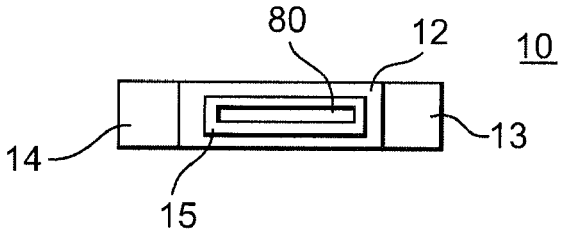
FIG. 13B is a top view of the connector of FIG. 13.
Figure 13C:
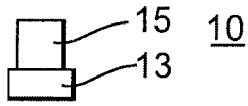
FIG. 13C is a right side view of the connector of FIG. 13.

FIGS. 12 and 12A–12B illustrate the connector 10 having a muntin bar tab 15 with resilient fingers 16 and adhesive 30.

The positioning tabs 70, 71 are attached to the base plate 12 at the locations 72. The positioning tabs 70, 71 hold the bottom of base plate 12 away from the inside base surface of the window channel until an installer is ready to position the muntin bar.

Referring now to FIGS. 13 and 13A–C thereshown is yet another embodiment of the connector 10 of the present invention. This version of the connector would be primarily for use with solid (not hollow) muntin bars, although it could be used with hollow muntin bars as well. Here, tab 15 is formed as a collar with a central opening 80 for receiving the muntin bar therein. In one embodiment, the perimeter of the central opening 80 matches the outer shape of the muntin bar. All patents and patent applications disclosed herein, including those disclosed in the background of the invention, are hereby incorporated by reference. Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention.

What is claimed is:

1. A connector, comprising:

a baseplate having first and second surfaces and at least a first edge;

a muntin bar tab extending from the first surface;

a first positioning tab connected to the first edge of the baseplate and rotatable about an axis formed generally along the first edge of the baseplate; and an attachment structure extending from the second surface.

2. The connector of claim 1, wherein the baseplate has a second edge and the connector further comprises:

a second positioning tab connected to the second edge, and rotatable about an axis formed generally along the second edge of the baseplate.

3. The connector of claim 1, further comprising at least one resilient finger extending from the muntin bar tab.

4. The connector of claim 3 wherein the first positioning tab further comprises a first locking tab and the resilient finger further comprises a lock, the locking tab being positioned to engage the lock when the first positioning tab is rotated to a first position.

5. The connector of claim 1, wherein the baseplate has a second edge and the connector further comprises:

a second positioning tab connected to a second edge, and rotatable about an axis formed along the second edge of the baseplate; and a resilient finger having a lock extending from the muntin bar tab, the second positioning tab further comprises a locking tab and the resilient finger further comprises a lock, the locking tab positioned to engage the lock when the second positioning tab is rotated to a second position.

6. The connector of claim 1, wherein the attachment structure comprises an adhesive.

7. The connector of claim 1, further comprising a locking tab positioned adjacent the muntin bar tab on the first surface.

8. The connector of claim 7, wherein the locking tab is positioned such that a muntin bar when installed can be interposed between the locking tab and the muntin bar tab.

9. The connector of claim 1 wherein the mutin bar tab comprises a central opening for receiving a mutin bar therein.

10. The connector if claim 1 wherein the first positioning tab extends above the attachment structure until the connector is engaged with a window frame.

11. A connector for holding a muntin bar in place, comprising:

a baseplate having first, second and third portions, the first portion being generally a rectangular prism with first and second major surfaces, and at least first and second edges, the second portion being connected to the first edge and rotatable about a first axis that is generally parallel with the first edge and having a first locking tab on a surface away from the second surface, the third portion being connected to the second edge and rotatable about a second axis that is generally parallel with the second edge and having a second locking tab located on surface away from the second surface;

a muntin bar tab extending from the first major surface;

a first resilient finger extending from the muntin bar tab, the first resilient finger having a first lock adapted to engage the first locking tab when the second portion is rotated about the first axis to a first predetermined position; and a second resilient finger extending from the muntin bar tab, the second resilient finger having a second lock adapted to engage the second locking tab when the third portion is rotated about the second axis to a second predetermined position.

12. A connector, comprising:

a baseplate having first and second major surfaces and a plurality of edges;

a mutin bar tab extending from the first surface;

at least one positioning tab connected to an edge of the baseplate and rotatable ralative to the baseplate;

a spring region between the baseplate and the positioning tab; and at least one attachment structure located on the second surface.

13. The connector of claim 12, further comprising:

a second positioning tab connected to an edge of the baseplate.

14. The connector of claim 13, wherein the attachment structure is located between the first and second springs regions.

15. The connector of claim 12, wherein the spring region is formed from the baseplate.

16. The connector of claim 12, wherein the spring region is formed of a different material than the baseplate.

17. The connector of claim 12 wherein the mutin bar tab comprises a central opening for receiving a mutin bar therein.

18. The mutin bar connector of claim 12 wherein the positioning tab extends above the attachment structure until the mutin bar connector is engaged with a window frame.

19. A method of installing a muntin bar for use between panes of glass in which a frame will separate the panes of glass using a connector having a baseplate, at least one positioning tab and an adhesive, comprising the steps of:

associating the connector with the muntin bar;

positioning the connector such that the at least one positioning tab is in contact with the frame, but the adhesive is not; and causing relative movement between the at least one positioning tab and the baseplate so that the adhesive is placed in contact with the frame.

20. A muntin bar connector adapted to be adhesively attached to a frame of a window, comprising:

a baseplate;

a muntin bar tab associated with the baseplate adapted to engage a muntin bar;

an adhesive associated with the baseplate; and a first positioning tab movable between first position and second positions relative to the baseplate, the first positioning tab extending above the adhesive relative to the frame when in the first position.

21. The muntin bar connector of claim 20, further wherein the first positioning tab has a hinged relationship with the baseplate.

22. The muntin bar connector of claim 20, further comprising a second positioning tab wherein the second positioning tab has a hinged relationship with the baseplate.

23. The muntin bar connector of claim 20, wherein the first positioning tab is a post extending from the baseplate.

24. The muntin bar connector of claim 23, wherein the post extends through the baseplate and is connected to the baseplate by a brace.

25. The muntin bar connector of claim 20 comprising a second positioning tab formed as a second post extending through the baseplate.

* * * * *

UNITED STATES PATENT AND TRADEMARK OFFICE

CERTIFICATE OF CORRECTION

PATENT NO. : 7,124,546 B2
APPLICATION NO. : 10/715634
DATED : October 24, 2006
INVENTOR(S) : John Wayne Scharff et al.

It is certified that error appears in the above-identified patent and that said Letters Patent is hereby corrected as shown below:

Column 6

Line 4, delete "if" and replace it with -- of --
Line 36, delete "ralative" and replace it with -- relative --

Signed and Sealed this

Twenty-sixth Day of December, 2006

JON W. DUDAS
*Director of the United States Patent and Trademark Office*